US007115227B2

(12) United States Patent
Mucciardi et al.

(10) Patent No.: US 7,115,227 B2
(45) Date of Patent: Oct. 3, 2006

(54) HEAT PIPE

(75) Inventors: Frank Mucciardi, St-Laurent (CA); John Gruzleski, Pointe Claire (CA); Guohui Zheng, Montréal (CA); Chunhui Zhang, Montréal (CA); Zhongsen Yuan, Montréal (CA)

(73) Assignee: McGill University, Montreal (CA)

( * ) Notice: Subject to any disclaimer, the term of this patent is extended or adjusted under 35 U.S.C. 154(b) by 0 days.

(21) Appl. No.: 10/925,372

(22) Filed: Aug. 25, 2004

(65) Prior Publication Data

US 2005/0077660 A1 Apr. 14, 2005

Related U.S. Application Data

(63) Continuation of application No. PCT/CA02/01394, filed on Sep. 13, 2002.

(60) Provisional application No. 60/358,724, filed on Feb. 25, 2002.

(51) Int. Cl.
*C21C 5/32* (2006.01)
*C21C 5/30* (2006.01)

(52) U.S. Cl. ..... 266/225; 266/223

(58) Field of Classification Search ..... 266/223, 266/225

See application file for complete search history.

(56) References Cited

U.S. PATENT DOCUMENTS 4,554,966 A 11/1985 Vasiliev et al.
5,159,972 A 11/1992 Gunnerson et al.
5,310,166 A 5/1994 Mast et al.

FOREIGN PATENT DOCUMENTS

WO WO 99/22032 * 5/1999

* cited by examiner

*Primary Examiner*—Scott Kastler
(74) *Attorney, Agent, or Firm*—Ogilvy Renault LLP

(57) ABSTRACT

A heat pipe assembly (10/110), under vacuum and having a working substance charged therein, comprising generally an evaporator (12/112) adapted to evaporate the working fluid and a condenser (16/116). The heat exchanging condenser is in fluid flow communication with the evaporator. The condenser is adapted to condense evaporated working substance received from the evaporator and has a reservoir (30/130), located at a higher elevation than the evaporator, for collecting liquid working fluid therein. A discrete, impermeable liquid return passage (36/136, 20/120) permitting the flow, by gravity, of the liquid working substance from the reservoir to the evaporator. The liquid return passage extends through the evaporator and terminates near the closed leading end thereof, and is fitted with a vent line (38/138) that diverts ascending vapor to the top of the condenser. A flow modifier (24/124) is positioned within the evaporator, causing swirling working fluid flow in the evaporator, whereby the flow modifier ensures that un-vaporized liquid entrained with evaporated working substance is propelled against inner surfaces (23/123) of the evaporator by centrifugal force to ensure liquid coverage of the inner surfaces, thereby delaying onset of film boiling.

27 Claims, 6 Drawing Sheets

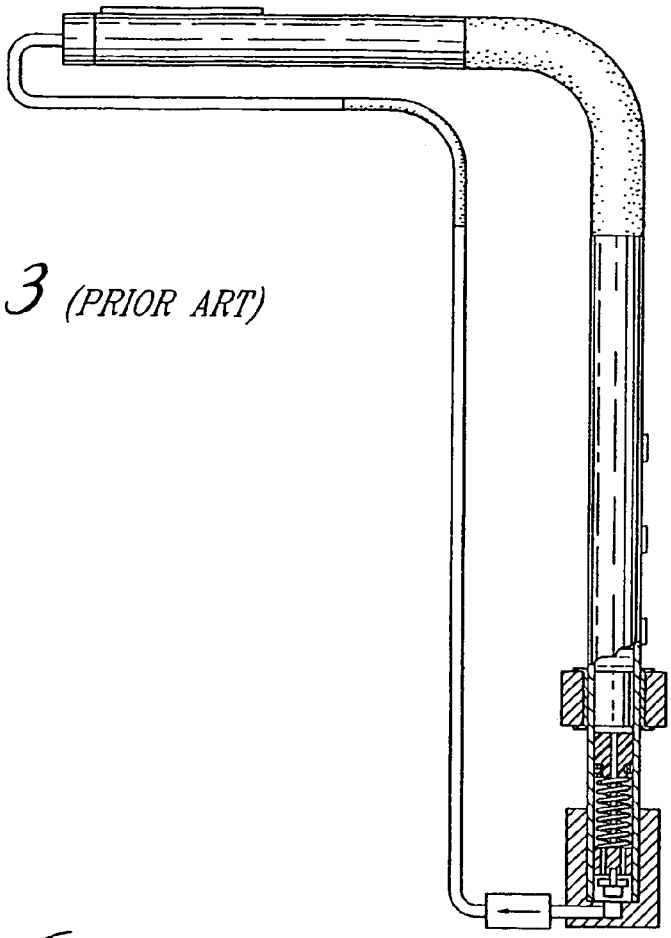
Fig. 3 (PRIOR ART)
Fig. 4 (PRIOR ART)
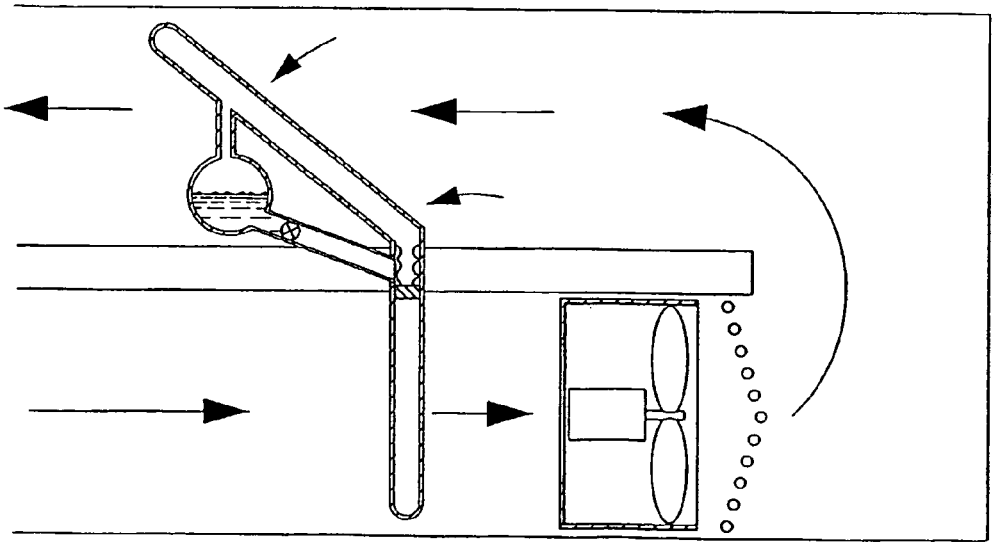

HEAT PIPE

RELATED APPLICATIONS

This is a continuation of International Patent Application No. PCT/CA02/01394 filed Sep. 13, 2002, which claims benefit of U.S. Provisional Patent Application No. 60/358,724 filed on Feb. 25, 2002.

BACKGROUND OF THE INVENTION

1. Field of the Invention

The present invention relates generally to a heat pipe, and more specifically to a semi-loop heat pipe having co-current, swirling two phase flow in the evaporator, and an impermeable return line from the condenser.

2. Description of the Prior Art

Heat pipes are devices that employ the evaporation and condensation of a working fluid contained within to effect the transfer of energy from the evaporator where heat is absorbed to the condenser where the heat is released. Heat pipes gained prominence in the early 1960's as superconducting, heat transfer devices as detailed, for example, in U.S. Pat. Nos. 3,229,759 and 4,485,670. While numerous configurations and applications of heat pipes have been proposed since their initial invention, the basic heat pipe is still viewed as a unit that can transport large quantities of energy over a relatively small temperature gradient.

Heat pipes are containment vessels that are charged with a working substance which is continuously evaporated and condensed as heat is added to the evaporator and removed from the condenser. The rate at which vapor is produced is directly proportional to the rate of heat flowing into the heat pipe. The ability of a heat pipe to efficiently transfer energy rests on the fact that non-condensable gaseous species within the chamber are removed from the heat pipe prior to operation. As such, a heat pipe is evacuated prior to its use as a heat transfer device. By eliminating non-condensable gases from the chamber, the vapor that is generated in the evaporator flows to the condenser down a pressure gradient in much the same way as a pump causes fluid to move through an enclosure. With the presence of non-condensable gases, the vaporized working substance would move by molecular diffusion down a concentration gradient. Given that a pressure driven flow can be orders of magnitude more effective in moving vaporized working substance, heat pipe systems are generally evacuated. Conversely, if the heat pipe chamber develops a leak, the heat pipe will cease to function. Thus, the use of a heat pipe in a high temperature environment can be problematic if the evaporator experiences insufficient cooling as this can cause the containment vessel to be perforated with the subsequent failure of the heat pipe.

Heat pipes can generally be classified into two main categories, namely, those wherein the vapor and liquid flow countercurrent to each other, and those wherein the liquid and vapor flow in a co-current manner. Countercurrent flow heat pipes are well known in the prior art. FIG. 1 shows a simple countercurrent heat pipe, where the vapor flow rises through the center from the evaporator at the bottom, is condensed in the upper portion and flows as liquid down the sides to the liquid pool in the evaporator. Their operation is well described by Grover in U.S. Pat. No. 3,229,759, and by Camarda et al. in U.S. Pat. No. 4,485,670. The combination of gravity and capillary forces generated within a wick on the interior walls of the heat pipe are used to return liquid working substance to the evaporator from the condenser.

Co-current heat pipes are generally referred to as loop heat pipes, examples of which are disclosed in U.S. Pat. Nos. 4,515,209 and 5,911,272, depicted respectively in FIG. 2 and FIG. 3. Both co-current and countercurrent heat pipes often contain a wick on the inner evaporator surface to ensure uniform coverage by utilizing the capillary forces generated by the wick to spread the liquid.

While both loop and non-loop (i.e. countercurrent) heat pipes have been used in a number of products and applications, they have not been incorporated in units where high heat fluxes at high operating temperatures are encountered and they are generally not used in large scale units. This is largely because such systems are amenable to failure of the containment material that forms the heat pipe. In order to ensure that the containment vessel has durability and a long life, it is necessary to have the entire evaporator of the heat pipe unit adequately cooled by the working substance in the unit. This has not been possible as yet with the heat pipes of the prior art.

Thus, insufficient cooling of even a relatively small region (e.g. 10 $mm^2$) can lead to the perforation and subsequent destruction of the heat pipe unit. Heat pipes of the prior art have rarely been intended for use in applications involving high operating temperatures, and as such, destruction of a heat pipe chamber as a result of exposure to elevated temperatures has never been adequately addressed.

A controllable heat pipe is described in U.S. Pat. No. 5,159,972 comprising a reservoir for the liquid and a separate return line to the top of the evaporator, as shown in FIG. 4. However, this heat pipe nevertheless fails to overcome the principle difficulties associated with all countercurrent heat pipes used in high heat flux applications.

The three main limitations of prior art heat pipes that must be overcome to make their use in high temperature applications feasible are: film boiling on the evaporator walls, levitation of the liquid returning to the evaporator, and configurational complexity of a loop heat pipe for certain applications.

The levitation of liquid from the leading end of the evaporator will reduce heat transfer efficiency and will, if the temperatures are high enough, cause the heat pipe to fail as a result of dry-out. The levitation of liquid is of greatest concern in large scale units where the length of the evaporator can be sizeable. In such units the refluxing of liquid down to the bottom of the evaporator can be a major concern because the total heat load on the unit can be large even if the heat flux is moderate. Since the heat load manifests itself as a vapor flow, the vapor velocity at the top of the evaporator of a large scale unit can be enough to create some degree of fluidization of the liquid.

The other principle difficulty with using heat pipes in high heat flux applications is the onset of film boiling on the evaporator walls. As is well known to those skilled in the art, this can reduce the rate of heat extraction by as much as an order of magnitude. This dramatically reduces the heat transfer efficiency and, in some cases, may lead to the destruction of the evaporator containment walls.

One possible use for heat pipes is in a reagent delivery unit such as a lance. U.S. Pat. No. 5,310,966 describes a heat pipe lance, or tuyere. However, the heat pipe lance of U.S. Pat. No. 5,310,966 fails to teach how to eliminate the levitation of liquid from the leading end of the evaporator or how to eliminate the formation of a stable vapor film on the inner walls of the evaporator.

Loop heat pipes can overcome the issue of entrainment, however, loop heat pipes are often not viable for many practical applications because of their configurational complexity, wherein the return loop pipe is run outside the main heat pipe body which significantly increases space requirements of the heat pipe. Nevertheless, as with countercurrent heat pipes, the problem of film boiling on the evaporator surfaces nevertheless remains.

The mechanism for evaporation remains an important limiting factor in a heat pipe, and especially for high heat flux applications. If the working substance is of low thermal conductivity and the heat flux is relatively high, the working substance will experience boiling at the interface between the liquid and the heat source. If the generation of vapor is sufficiently intense, a stable vapor film will ultimately form between the liquid phase of the working fluid and the evaporator wall. This vapor film will greatly inhibit heat transfer. The evaporator has then attained its boiling limit, and the subsequent result of continued exposure to the heat flux can be overheating of the evaporator walls and possible failure of the heat pipe.

SUMMARY OF THE INVENTION

It is an object of the present invention to provide a an improved heat pipe.

It is another object of the present invention to provide a heat pipe capable of extracting heat from high temperature systems.

It is another object of the present invention to provide a heat pipe having an evaporator flow modifier.

It is a further object of the present invention to provide a heat pipe having a solid wall return pipe from the condenser to the evaporator.

Therefore, in accordance with the present invention, there is provided a heat pipe assembly, under vacuum and having a working substance charged therein, comprising: an evaporator adapted to evaporate the working substance and having a closed leading end; a heat exchanging condenser being in fluid flow communication with the evaporator, the condenser being adapted to condense vaporized working substance received from the evaporator and having a reservoir located at a higher elevation than the evaporator for collecting liquid working substance therein; a discrete, impermeable liquid return passage permitting the flow, by gravity, of the liquid working substance from the reservoir to the evaporator; the liquid return passage extending through the evaporator and terminating near the closed leading end thereof; and a flow modifier positioned within the evaporator section, causing swirling working substance flow in the evaporator; whereby the flow modifier ensures that un-vaporized liquid entrained with evaporated working substance is propelled against inner surfaces of the evaporator by centrifugal force to ensure liquid coverage of the inner surfaces, thereby delaying onset of film boiling.

In accordance with the present invention, there is also provided a method of heat extraction from a material, comprising the steps of: providing a heat pipe assembly having an evaporator and a heat extracting condenser in fluid flow communication therewith, the evaporator comprising a flow modifier therein adapted to cause swirling of a working substance flow in the evaporator, and the condenser being cooled to condense the vaporized working substance received from the evaporator; providing a discrete, impermeable liquid return passage between the condenser and a leading end of the evaporator; selectively permitting the flow, by gravity, of the liquid working substance from the condenser to the evaporator through the liquid return passage; and placing the evaporator in heat transfer communication with the material to be cooled.

There is additionally provided, in accordance with the present invention, a method of injecting a reagent into a high temperature material, comprising the steps of: providing a heat pipe assembly having an evaporator and a heat extracting condenser in fluid flow communication therewith, the evaporator comprising a flow modifier therein adapted to cause swirling of a working substance flow in the evaporator, and the condenser being cooled to condense the vaporized working substance received from the evaporator; providing a discrete, impermeable liquid return passage between the condenser and a leading end of the evaporator; permitting the flow, by gravity, of the liquid working substance from the condenser to the evaporator through the liquid return passage; providing a reagent delivery conduit passing through the evaporator and emerging at the leading end thereof; and conveying the reagent through the reagent delivery conduit and injecting the reagent into the high temperature material.

BRIEF DESCRIPTION OF THE DRAWINGS

Further features and advantages of the present invention will become apparent from the following detailed description, taken in combination with the appended drawings, in which:

FIGS. 2 and 3 show partial cross-sectional views of loop heat pipes of the prior art.

FIG. 4 shows a schematic cross-sectional view of a non-loop heat pipe of the prior art.

DESCRIPTION OF THE PREFERRED EMBODIMENTS

Figure 1:
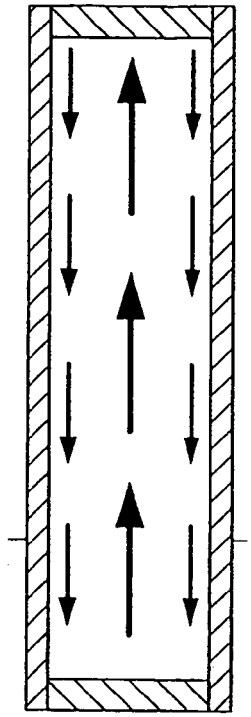
Fig. 1 (PRIOR ART)
FIG. 1 shows a cross-sectional view of a simple countercurrent heat pipe of the prior art.
Figure 2:
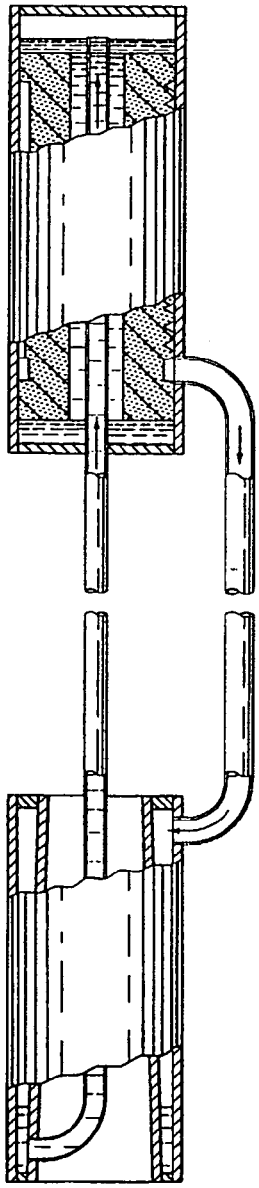
Fig. 2 (PRIOR ART)
Figure 5:
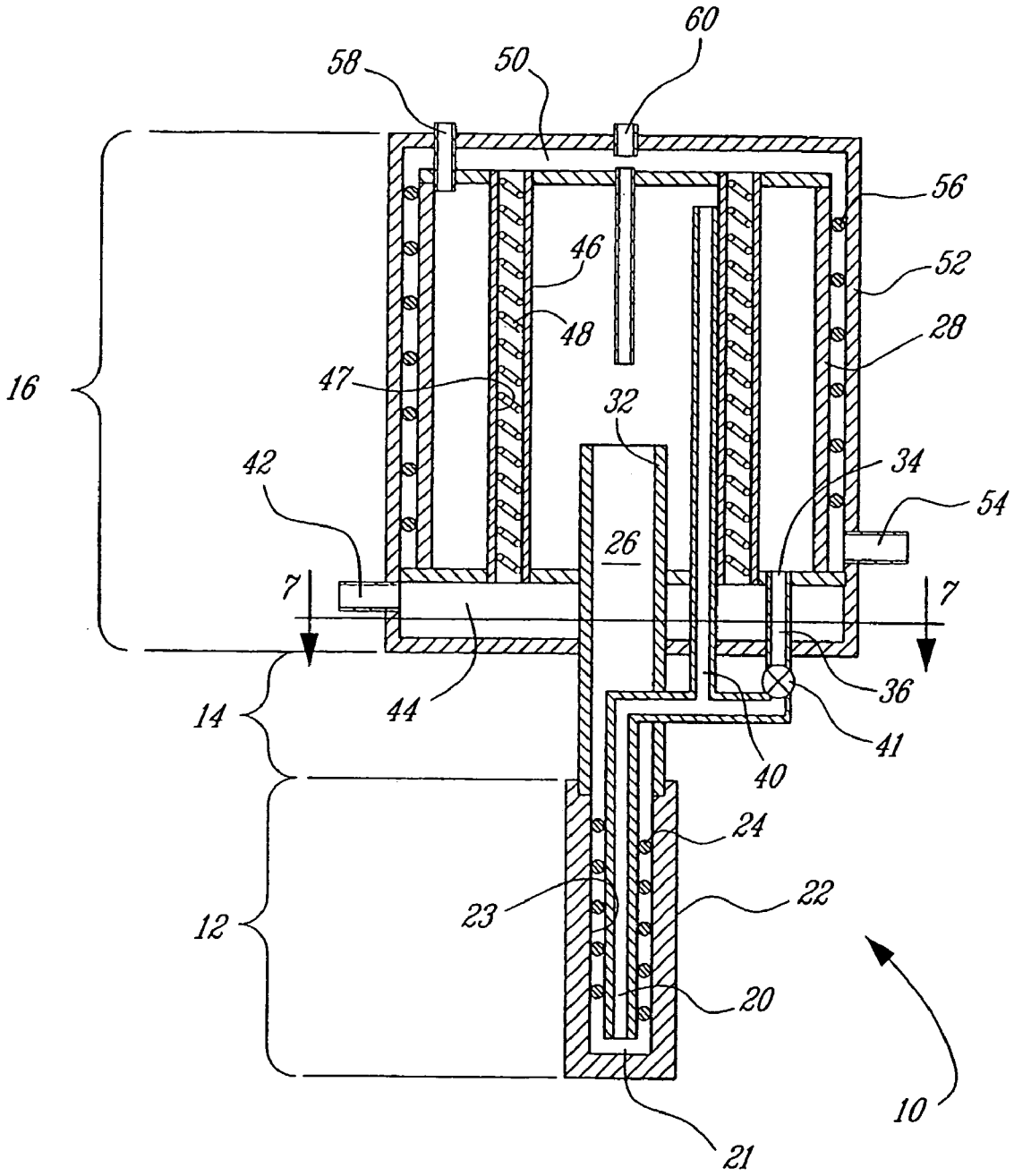
FIG. 5 shows a vertical cross-sectional view of a heat pipe of the present invention.
Figure 6:
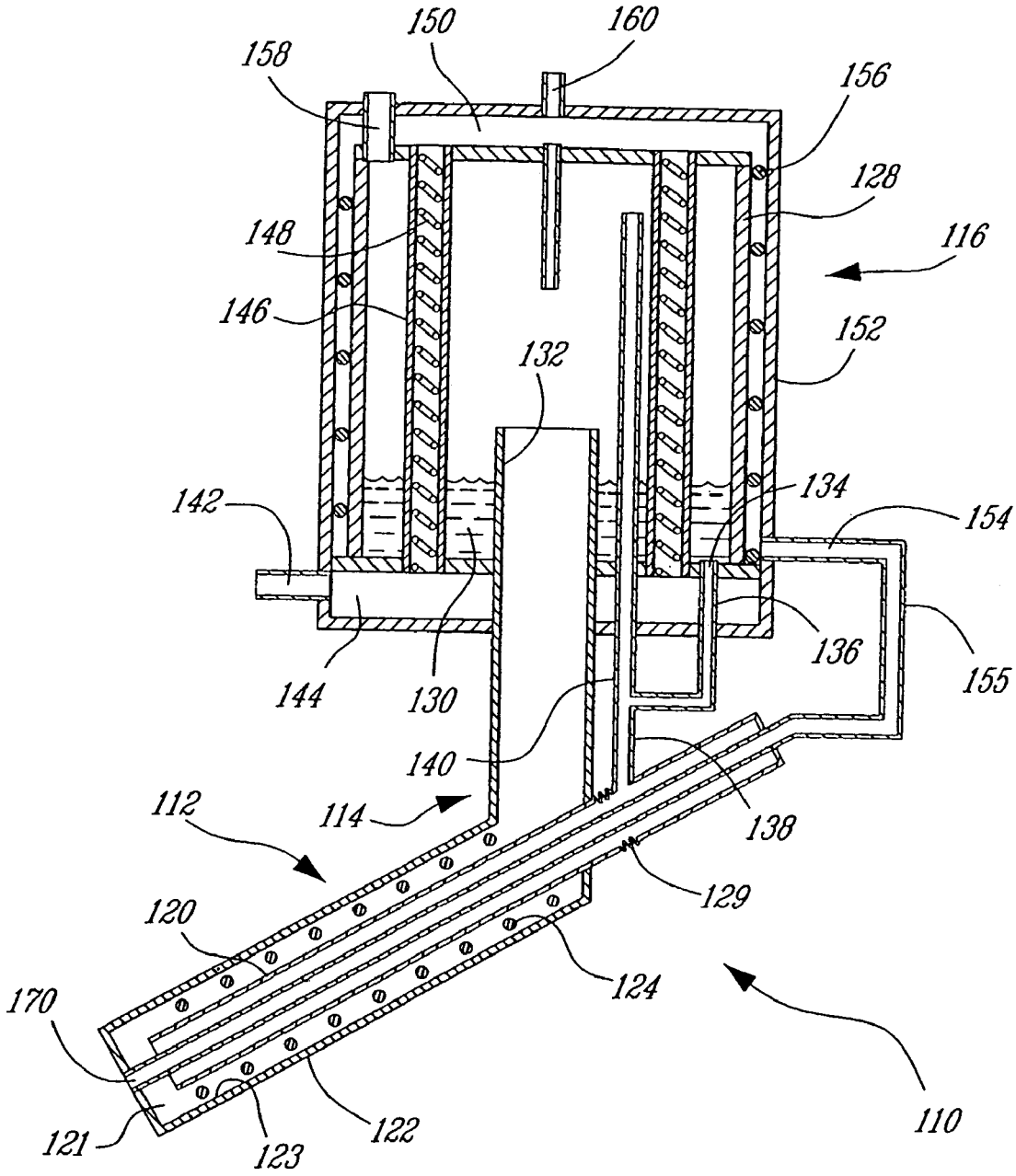
FIG. 6 shows a vertical cross-sectional view of a second embodiment of the heat pipe of the present invention.

The heat pipe of the present invention is comprised principally of an evaporator, a coupling element, and a condenser, and comprises generally two principle embodiments, whose main classes of applications are as an energy extractor as shown in FIG. 5, and as a injection unit as shown in FIG. 6. In the latter, the heat pipe has one or more conduits that run through the unit to carry reagents. Examples of the use of such a heat pipe would be injection lances, tuyeres and burners. In the former class of applications, the heat pipe has no reagent-carrying conduit in the heat pipe, and is used for transferring energy, for example as a heat extraction device. The two embodiments are thus differentiated by whether or not a reagent is transported through the heat pipe unit.

Referring to FIG. 5 showing the first embodiment of the invention, the energy extraction heat pipe unit 10 comprises generally an evaporator 12, a coupling element 14, and a condenser 16.

The evaporator portion 12 sits in a hot, and sometimes harsh, environment. It can include one or more conduits for transporting a reagent when the heat pipe unit is used as an injection device, as shown in FIG. 6. Attached to the evaporator is the coupling element 14, which permits fluid flow communication between the evaporator 12 and the condenser 16. The coupling element 14 can be either rigid or flexible, and its shape and configuration can vary as necessary from one application to another. It is used to maintain a vertical orientation of the condenser, regardless of the position or orientation of the evaporator. The upper extension of the wall of the coupling element 14 protrudes into the condenser and help form the liquid reservoir.

The condenser 16, positioned at a higher elevation than the evaporator 12, is the portion of the heat pipe in which the vapor phase of the working substance is condensed. Condensation of the vapor is achieved by configuring the condenser as a heat exchanger. External cooling of the condenser is achieved by using internal cooling passages as well as by using a cooling jacket on the external walls of the condenser, which will be discussed further below. The condenser is chosen such that its cross-sectional area can be substantially larger than that of the evaporator. In this way, the levitation of liquid within the condenser is completely eliminated.

The two phase flow of the working fluid, that is generated in the evaporator 12 as a result of the heat to which it is exposed, moves upward through the coupling element 14 into the condenser 16 with outer body walls 28. The condenser confines and cools the vapor/liquid working substance, causing the two phase fluid to condense into liquid and settle in the reservoir portion 30, formed between the condenser outer walls 28 and the extension wall 32 of the upper portion of the coupling element 14. Liquid collected in the condenser 16 then flows by gravity through the drain hole 34 and into the upper return line 36, which can be a flexible line. The return line 36 is joined to a vent line 38 at a 'T' junction 40. The vent line 38, which can be a flexible line, connects the upper return line to the top of the condenser. In this way, any vapor that infiltrates into the return line is diverted into the vent line and released in the low pressure region of the condenser. The upper return line 36 then joins into the impermeable lower return line 20, to deliver liquid working substance back to the leading end 21 of the evaporator 12 as a separate stream which is shielded from the ascending flow and is thus not affected by it. The return line 20 terminates near the leading end 21 of the evaporator 12. A preferred termination distance is two times the internal diameter of the return line 20. This discontinuity at the discharge end of the return line of the heat pipe has resulted in the present invention being referred to as a 'semi-loop' heat pipe.

By incorporating a solid wall return line within the confines of the evaporator, it is possible to return liquid to the leading end without adopting a conventional loop configuration. Maintaining an adequate liquid head in the return line and the reservoir, coupled with a sufficiently high liquid velocity at the discharge end of the return line, minimizes the quantity of vapor that can enter the return line. Moreover, fitting the return line with a vent line is sufficient to provide a stable flow of liquid to the evaporator.

Figures 8A, 8B, 8C:
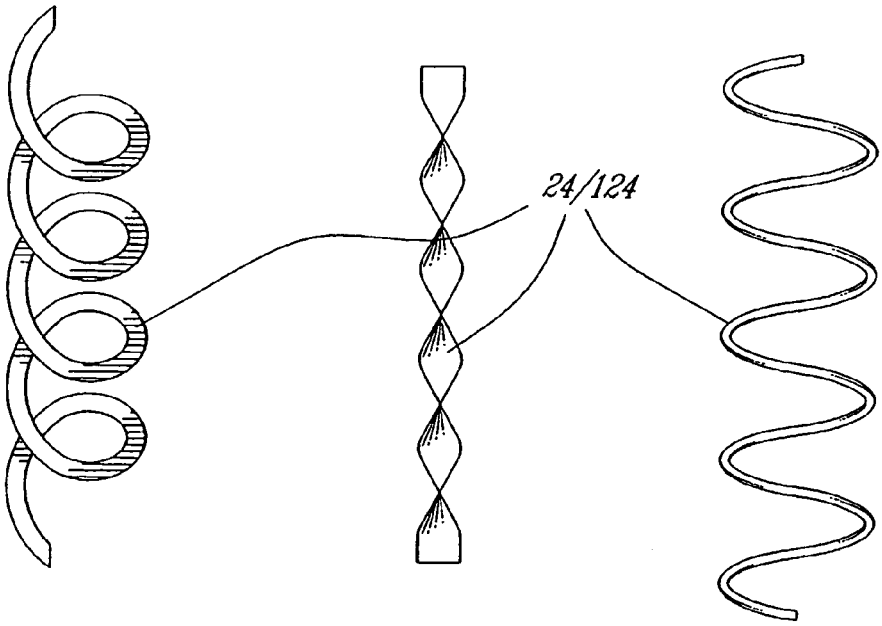
FIGS. 8*a* to 8*c* show perspective schematics of possible flow modifiers to be used in the present invention.

A flow modifier 24 is located within the evaporator 12 along the inner surface 23 of the evaporator wall 22. The flow modifier 24 is preferably generally helical in shape, and preferably comprises one of a helical swirler, a twisted tape and a helical spring, as depicted in FIGS. 8*a* to 8*c* respectively. As the evaporator wall 22 is exposed to heat flux and the working fluid undergoes vaporization,. the flow modifier 24 creates a swirling flow over the evaporator walls and any excess liquid not vaporized is swirled by centrifugal force onto the entire evaporator inner wall surface 23 to effectively cool the wall, and thereby prevent the occurrence of film boiling. The two phase flow therefore ascends the evaporator, the liquid coating the walls of the evaporator, and any liquid not vaporized during the ascent is simply collected in the reservoir 30 located in the condenser 16.

The type and dimensions of the swirling flow modifier 24 to use in a given heat pipe is determined by several parameters for a given application such as the rate at which vaporized working substance is generated per unit of time and the cross-sectional area of the heat pipe.

To ensure that all the evaporator walls are contacted by liquid, it is necessary to return liquid to the bottom of the evaporator, preferably through the core of the evaporator in the eye of the swirling flow where the pressure is lowest. It is preferable that the excess quantity of liquid that is returned be as much as 10 times or more than that required for vaporization. This will ensure that the centrifugal force arising from the swirling flow maintains the evaporator walls completely covered with liquid. For example, a water-based heat pipe that is extracting 4 kW will cause about 2 g/s of water to be vaporized. The return line for such a unit must therefore return at minimum 2 g/s, with a significantly higher return rate (10–20 g/s) being preferred.

Figure 7:
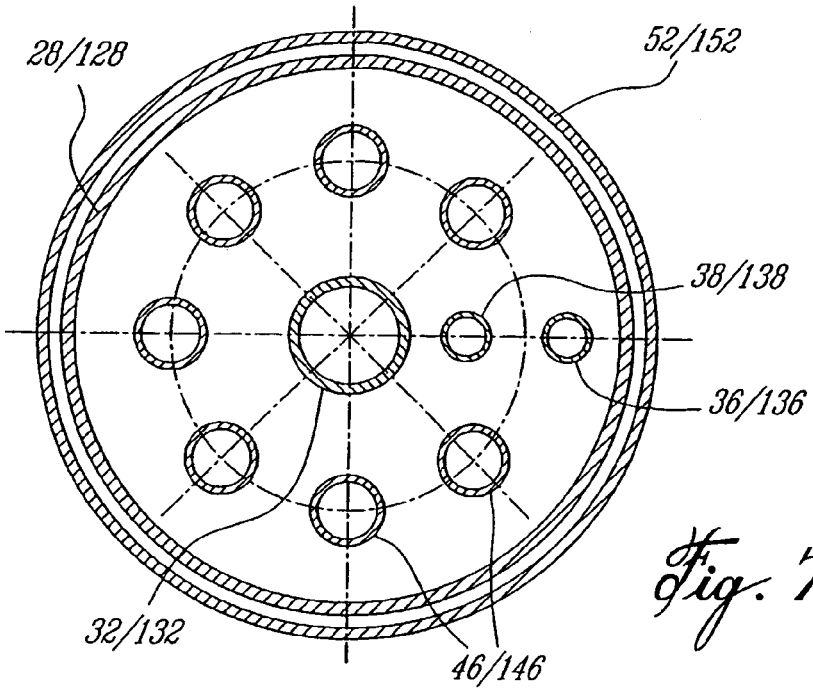
FIG. 7 shows a horizontal cross-sectional plan view taken along line 7—7 of FIG. 5 and FIG. 6.

To dissipate the heat that is transported from the evaporator to the condenser by the vapor molecules, an external coolant, for example air, water or oil, is used. Referring to FIGS. 5, 6 and 7, the external coolant is fed through inlet 42 into a header 44 that sits below the reservoir 30. The coolant then flows up through a series of passages or cooling tubes 46. Each of these tubes is fitted with a twisted tape insert 48 on the inner wall surface 47 to enhance the heat transfer by causing the coolant to swirl. In this way, the effect of the centrifugal force causes the denser, colder coolant up against the walls of the tubes where the coolant can absorb heat from the condensing working substance.

The coolant leaving the cooling tubes 46 enters a discharge header 50 whereupon the coolant is diverted into a jacket formed by outer member 52 and the condenser wall 28. The coolant leaves the jacket via port 54. The outer jacket is also fitted with a spring type, swirling device 56 to enhance turbulence and thus heat transfer. In an alternate embodiment of the condenser, the cooling tubes 46 along with the inlet header 44 and the outlet header 50 can be eliminated. The cooling would in this case be achieved by the flow of coolant in the jacket formed by the condenser wall 28 and the surrounding outer member 52. In another alternate embodiment, the jacket could also be eliminated and natural or forced cooling from the condenser wall 28 would provide all the necessary heat dissipation. One skilled in the art would be able to determine which configuration is appropriate for a given system.

The condenser also incorporates a filling and evacuation tube 58. This is used, as the name implies, to charge the heat pipe with the working fluid, and to evacuate any non-condensable gases. In addition, the condenser can be fitted with a thermocouple well 60 which can house one or more thermocouples used to monitor the operation of the heat pipe. Both the evacuation tube 58 and the thermocouple well 60 are made in such a way as to compensate for thermal expansion effects.

As one of the significant limitations of the prior art heat pipes used in high heat flux applications was the early onset of film boiling in the evaporator, the flow modifying swirler of the present invention, which substantially resolves this problem, is an important preferred feature of the present heat pipe, and as such was experimentally tested to ensure it provided the desired results.

To illustrate the effectiveness of a simple twisted tape flow modifier, two identical heat pipes with water as the working substance were tested in the following manner. The evaporators of the heat pipes were immersed in molten zinc and the zinc was then allowed to freeze and cool. The zinc was then reheated and the rate of heat extraction by each heat pipe was measured as a function of the zinc temperature. As the zinc was heated, both pipes extracted a correspondingly larger quantity of heat. However, as the zinc attained its melting point (419° C.) and the interfacial contact resistance between the zinc and the heat pipe disappeared, the rate of heat extraction of the heat pipe with the flow modifier increased rapidly while that for the pipe without a flow modifier decreased dramatically. These results therefore show the effectiveness of a flow modifier in suppressing film boiling. The tests have shown that the use of a flow modifier can enhance heat extraction by as much as an order of magnitude or more.

Figure 9:
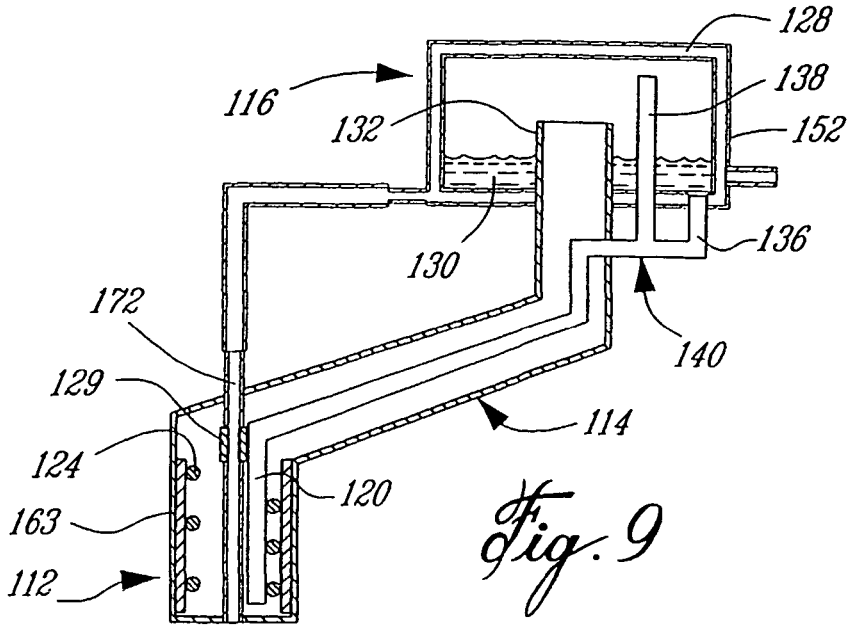
FIG. 9 shows a vertical cross-sectional view of alternate embodiment of the heat pipe of the present invention.

While the heat pipe of the present invention can, much as those of the prior art, have a wick 163 located on the inner wall surface of the evaporator as shown in FIG. 9, in the preferred embodiment of the present invention the inner walls 23 of the evaporator 12 are not fitted with a wick but instead textured with a multitude of grooves therein. The grooves preferably have the same pitch as the flow modifier. The ridges of the grooves can be, for example, 1 mm or less in height and the width can also be 1 mm or less. The incorporation of such a textured surface can be beneficial in promoting uniform coverage on the walls by the ascending fluid flow, and therefore especially useful if the working substance is prone to film boiling for the operating conditions and/or the thermal conductivity of the liquid working substance is relatively low, such as for water, thermex, and ammonia for example. Tests have shown that the wick can physically trap a vapor film and reduce heat transfer by a sizeable amount even with a swirling flow. Thus, it is preferred to return excess liquid to ensure complete coverage by the combined effect of the swirling upward flow and centrifugal force rather than incorporate a wick on the inner walls of the evaporator.

The upper return line 36 can be fitted with a valve 41, as shown in FIG. 5. This is of particular advantage in processes where the heat pipe may be required to be turned on and off. Thus, the heat pipe can be turned off by closing the valve 41, which ensures all the condensed liquid is retained in the reservoir 30. When heat extraction is required, the valve 41 is opened, allowing the liquid to flow down into the evaporator and extract heat. When heat extraction is to be terminated, the valve is simply closed. This type of configuration is especially advantageous in the cooling of casting molds. Moreover, one can also control the rate of heat extraction if required, by adjusting the opening of the valve.

In a slight variation of the preferred embodiment of the present invention, the evaporator wall 22 can formed by drilling a hole into a solid material, and then attaching the coupling element 14 directly to the hole. The hole therefore constitutes the evaporator of the heat pipe. Such a configuration can be of advantage over the insertion of a heat pipe into a cavity which can give rise to a sizeable contact resistance. By making the drilled cavity the evaporator of the heat pipe, one can eliminate this contact resistance. Possible applications of this configuration include the cooling of solid masses such as casting molds, furnace walls, tap holes, engines, heat exchangers and the like.

As originally mentioned, there are two main classes of applications envisaged for the present invention: as an energy extractor and as a injection unit as shown in FIG. 6. The heat pipe can be configured not only to act as a energy extractor, as described above, but also to deliver a reagent as an injection unit, which will now be described in further detail. For such heat pipe injector unit applications, the heat pipe simply has one or more conduits that run through the unit to carry reagents, and can be used as injection lances, tuyeres and burners for metallurgical applications.

Thus, in the embodiment of the present invention depicted in FIG. 6, the heat pipe 110 is fitted with a reagent delivery conduit 170. While only one conduit is shown, it should be obvious to one skilled in the art that multiple conduits carrying a variety of reagents can also be used. In the subsequent description of the reagent delivery heat pipe unit, it is assumed for the sake of simplicity that only one reagent is to be conveyed.

The evaporator 112 comprises a central reagent conduit 170 which is surrounded by a working fluid return line 120. While the return line 120 does not necessarily have to fit over the reagent conduit 170 and can be a separate pipe which is located next to the conduit as is shown in FIG. 9, it is preferred to have the return line 120 outside and concentric with the reagent conduit 170, which is positioned in the center of the heat pipe evaporator so as to maintain symmetry for the swirling flow. The outer walls 122 of the evaporator body may have a textured inner surface 123 if it is deemed appropriate for a specific application. On the other hand, one may replace the textured surface with a wick. In general, a wick can be used if the liquid working substance has a high thermal conductivity, such as for alkali metals such as sodium, however, a wick should preferably not be used if the heat pipe contains a working substance of low thermal conductivity such as water or thermex for example. A flow modifier 124 is then inserted into the evaporator core. The flow modifier can be, as previously described, a spring, twisted tape, or a helical, blade-shaped, swirling device. The flow modifier 124 shown in FIG. 6 is a spring.

The choice of wicks and flow modifiers is dependent on the heat pipe/working substance combination to be used. For high velocity flows of the working substance, a spring is preferred, while for low velocity systems, a helical shape is better. In both cases, the return line assembly passes through the center of the flow modifier. Wicks can be made from screen or sintered materials with pore size and porosity being chosen by one skilled in the art as required.

In FIG. 6 the return line 120 is positioned over the central reagent conduit 170. The role of the return line, as it was for the energy extraction embodiment of FIG. 5, is to deliver liquid to the leading end of the heat pipe. To do this, it is necessary to minimize the quantity of vapor that enters the leading end of the return line. There are several ways this is accomplished. One is to run the return line 120 over the reagent conduit 170. In this way, liquid in the return line is cooled and any vapor that attempts to move up the return line is condensed.

When the return line is a separate line, such as in FIG. 9 where the reagent delivery conduit 172 runs separately, the liquid is not cooled by the reagent. Thus, the flow of vapor up the return line is a greater possibility. If this flow of vapor is allowed to establish itself throughout the return line and into the condenser, it is possible that liquid will not return. To correct this potential problem, the return line 120 is fitted with a vent line 138 which pulls off ascending vapor and delivers it to the top of the condenser where the pressure is lowest. As the liquid head in the reservoir 130 and the drain pipe 136 reaches a sufficient size, liquid starts flowing down the return line. Once the returning flow of liquid gathers sufficient velocity, vapor is prevented from entering the leading end of the return line. The drain pipe 136 and the vent line 138 are connected together at a 'T' junction 140.

While it appears that a return line that is separated from the discrete reagent delivery conduit 172 has the disadvantage that the liquid is not cooled by the reagent, it does, however, have the advantage that liquid can flow more easily through this configuration as the drag of the walls is less for a given cross-sectional area. Thus, heat pipe units of relatively small size should use the separated return and reagent delivery lines shown in FIG. 9, while larger units can use the concentric return line design shown in FIG. 6.

The condenser 116 is a heat exchanger, and is substantially similar to the condenser 16 as previously described. While a number of configurations are viable, the preferred configuration is as shown in FIG. 6. The outer body 128 of the condenser 116 confines the vapor/liquid working substance. The reservoir 130 is formed between the outer walls 128 and the extension walls 132 of the coupling element 114. Liquid collected in the condenser is drained through the drain hole 134 into the upper return line 136, which can be a flexible line if required. The upper return line 136 is joined to a vent line 138 at a 'T' junction 140. This assembly then joins into the annular return pipe 120 via a bellows expansion connection 129. This expansion connection 129 compensates for thermal expansion differences between the evaporator body 112, the reagent conduit 170, and the return line 120 extending through the evaporator 112.

A distribution header 144 for the reagent sits below the condenser chamber. It is fed reagent through feed port 142. The reagent then flows through a collection of cooling tubes 146. Each of the tubes is fitted with a twisted tape insert 148 to enhance the heat transfer by causing the reagent to swirl. In this way the effect of centrifugal force pushes denser colder reagent up against the walls where it can absorb heat from the condensing working substance.

The reagent leaving the cooling tubes 146 enters a discharge header 150 whereupon the reagent is diverted into a jacket formed by surrounding outer member 152 and the condenser wall 128. The reagent leaves the jacket via exit port 154 and flows through tubing 155 which connects it to the top end of the reagent delivery conduit 170. The outer jacket is also fitted with a spring, swirling device 156 to enhance turbulence and thus heat transfer.

The condenser also incorporates a filling and evacuation tube 158. In addition, the condenser is fitted with a thermocouple well 160 which can house one or more thermocouples that are used to monitor the operation of the heat pipe.

While the description of the injection heat pipe unit for conveying reagent has focused on the angled unit shown in FIG. 6, it is equally applicable to a vertical unit as shown in FIG. 9. The basic differences between the two units are the orientation of the evaporator and the shape of the coupling segment. Another difference as noted earlier is the configuration of the return line, however this has no implication on the structure of the condenser.

Figure 10:
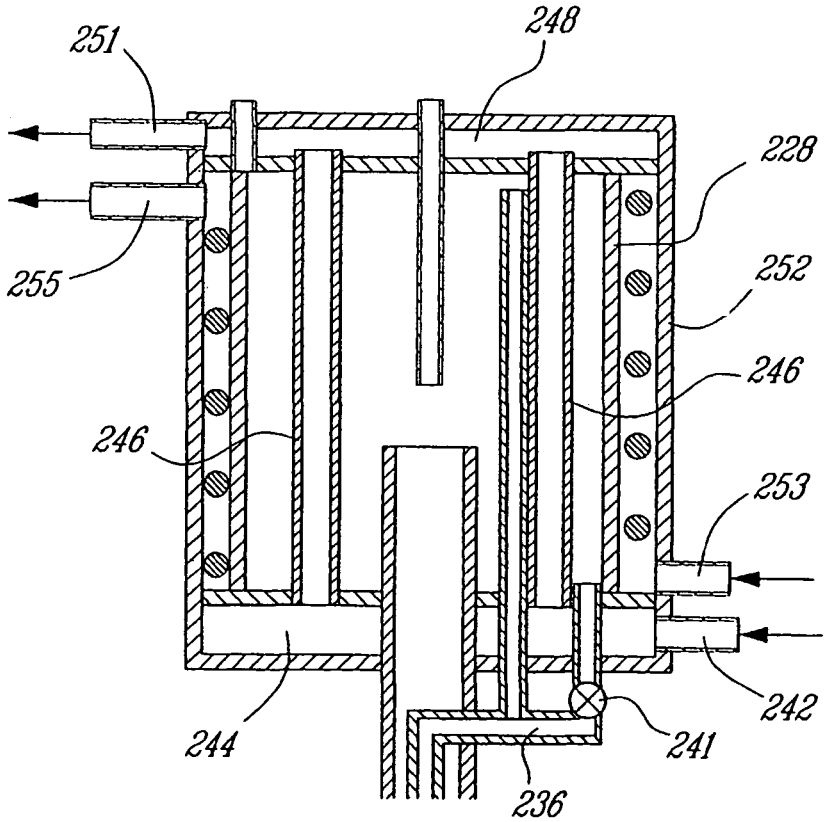
FIG. 10 shows a vertical cross-sectional view of an alternate embodiment of a condenser used in accordance with the present invention.

In some cases, it may be desirable to have more than the reagent cool the condenser. This condition can arise if the heat load on the evaporator is large enough that cooling with only one reagent is not sufficient. To overcome this, the condenser can be divided into multiple cooling circuits. An example of such a condenser is shown in FIG. 10. In this case, the reagent enters the feed header 244 via inlet 242. The reagent flows up through the cooling tubes 246 into the top header 248 and exits via port 251, and can then be piped to the reagent conduit 170 and fed into it. Another coolant, for example air, is fed into inlet 253 and flows through the outer jacket formed by the condenser walls 228 and the outer jacket member 252, and exits at the outlet 255. In this way, the heat extraction capability of the heat pipe can be controlled for a fixed feed of reagent. Additionally, a valve 241 located in the upper return line 236 for returning liquid working substance from the condenser to the evaporator, can be used to control the heat extraction of the heat pipe assembly. Naturally, other possibilities of configuring the condenser are viable. The configuration shown in FIG. 10 is used to simply illustrate the concept.

The choice of working substance to use in a heat pipe unit irrespective of whether or not the unit is used to carry reagent, will depend on several factors including the heat flux and the operating temperatures. While many choices for working substances are possible, the preferred working substance for high heat fluxes is sodium or another alkali metal such as potassium. With sodium the heat pipe unit can handle high heat fluxes while operating at a temperature of about 600° C. If the operating temperature is to be substantially less, then water or organic substances such as thermex can be used as the working substance.

The heat pipe unit must be evacuated during the preparation stage, such that much of the non-condensable, inert gases within the unit are extracted from the heat pipe before it is sealed. When there are no inert gases in the unit, one can use the maximum area for condensation. Moreover, the vaporized working substance molecules are forced into the condenser by the ensuing pressure differentials that arise because of the ongoing vaporization and condensation processes.

The quantity of working substance to charge into the heat pipe may vary. While the prior art generally advocates charging a relatively small quantity, the present invention allows for the charging of an excess quantity. The minimum amount of working substance to be charged is such as to ensure that there is sufficient coverage of the evaporator during operation. The maximum amount to use is dictated by the size of the reservoir. The entire quantity of working substance should fit inside the reservoir. The preferred quantity to charge is 50–90% of the reservoir volume, an amount that approximately equals the volume of the evaporator.

The choice of coolant for the condenser will depend on several basic heat transfer considerations. While air is the preferred choice, it is also possible to use water or oil as the coolant. Ultimately the choice will be determined by such factors as availability and economics. As a general rule, if the heat pipe is operated at a high temperature then a gas such as air is a viable coolant. If, however, the pipe is operated at a low temperature then a liquid such as water may be a more desirable coolant.

The invention claimed is:

1. A heat pipe assembly, under vacuum and having a working substance charged therein, comprising:

an evaporator adapted to evaporate the working substance and having a closed leading end;

a heat exchanging condenser being in fluid flow communication with the evaporator, the condenser being adapted to condense vaporized working substance received from the evaporator and having a reservoir located at a higher elevation than the evaporator for collecting liquid working substance therein;

a discrete, impermeable liquid return passage permitting the flow, by gravity, of the liquid working substance from the reservoir to the evaporator;

the liquid return passage extending through the evaporator and terminating near the closed leading end thereof; and a flow modifier positioned within the evaporator, causing swirling working substance flow in the evaporator;

whereby the flow modifier ensures that un-vaporized liquid entrained with evaporated working substance is propelled against inner surfaces of the evaporator by centrifugal force to ensure liquid coverage of the inner surfaces, thereby delaying onset of film boiling.

2. The heat pipe assembly as defined in claim 1, wherein the condenser is cooled by radiation and convection on external surfaces thereof.

3. The heat pipe assembly as defined in claim 1, wherein the condenser is force cooled by at least one cooling pipe running through the condenser core, having a coolant fluid flow therethrough.

4. The heat pipe assembly as defined in claim 3, wherein the cooling pipe is in fluid flow communication with at least one coolant header.

5. The heat pipe assembly as defined in claim 4, wherein the cooling pipe runs longitudinally through the core of the condenser, between a coolant header at the bottom and a coolant header at the top thereof.

6. The heat pipe assembly as defined in claim 5, wherein the coolant headers are force cooled.

7. The heat pipe assembly as defined in claim 1, wherein the evaporator and the condenser are cylindrical.

8. The heat pipe assembly as defined in claim 1, wherein the inner surfaces of the evaporator have grooves thereon.

9. The heat pipe assembly as defined in claim 8, wherein the grooves have a first pitch corresponding and being substantially equal to a second pitch of the flow modifier.

10. The heat pipe assembly as defined in claim 1, wherein a coupling element connects the evaporator and the condenser, and provides fluid flow communication therebetween.

11. The heat pipe assembly as defined in claim 1, wherein a vent line provides fluid flow communication between the liquid return passage and an upper portion of the condenser, whereby any vapor that moves up the liquid return line from the leading end of the evaporator is diverted to the upper portion of the condenser.

12. The heat pipe assembly as defined in claim 10, wherein at least one of the coupling element and the liquid return passage is flexible.

13. The heat pipe assembly as defined in claim 11, wherein the vent line is flexible.

14. The heat pipe assembly as defined in claim 1, wherein the condenser comprises a thermocouple well adapted to receive at least one thermocouple, used to monitor performance and to detect failure of the heat pipe assembly.

15. The heat pipe assembly as defined in claim 1, wherein the condenser has an internal cross-sectional area that is about 1 to 50 times a cross-sectional area of the evaporator.

16. The heat pipe assembly as defined in claim 1, wherein the liquid return passage has a sufficient size to deliver liquid at a rate that is about 1 to 100 times a vaporization rate of working substance within the evaporator.

17. The heat pipe assembly as defined in claim 1, wherein the flow modifier is one of a helical swirler, a twisted tape, and a helical spring.

18. An energy extraction device, comprising a heat pipe assembly as defined in claim 1.

19. The energy extraction device as defined in claim 18, wherein the liquid return passage comprises a valve therein adapted to turn the heat pipe assembly on and off by respectively permitting and blocking liquid flow to the evaporator.

20. The energy extraction device as defined in claim 19, wherein the valve can partially restrict liquid flow to the evaporator in order to control heat extraction rates.

21. The energy extraction device as defined in claim 18, wherein the evaporator is defined by a hole formed in a solid impermeable mass, and the heat pipe assembly is adapted for cooling the solid mass.

22. The heat pipe assembly as defined in claim 1, wherein the heat pipe assembly is a reagent injection device having at least one reagent delivery conduit, passing through a core of the evaporator and emerging at the leading end thereof, each adapted to convey a reagent therein.

23. The heat pipe assembly as defined in claim 22, wherein the reagent injection device defines at least part of one of a lance and a tuyere, to inject gaseous reagents into melts from varying discharge heights up to and including submerged injection.

24. The heat pipe assembly as defined in claim 22, wherein the reagent injection device defines at least part of a burner, to inject a combustible and an oxidant to generate heat.

25. The heat pipe assembly as defined in claim 22, wherein the reagent is used to cool the condenser, thereby pre-heating the reagent with energy extracted from the evaporator.

26. The heat pipe assembly as defined in claim 22, wherein the condenser comprises multiple cooling circuits, each adapted to receive one of a reagent and a supplemental coolant.

27. The heat pipe assembly as defined in claim 22, wherein an expansion joint is located on the reagent delivery conduit to compensate for differential expansion and contraction thereof.

* * * * *